US006050562A

United States Patent [19]

Long

[11] Patent Number: 6,050,562

[45] Date of Patent: Apr. 18, 2000

[54] STACKED SHEET FEEDER

[76] Inventor: John Albert Long, c/o Longford Equipment International Limited, 41 Lamont Ave., Scarborough, Ontario, Canada, M1S 1A8

[21] Appl. No.: 09/103,012

[22] Filed: Jun. 23, 1998

[51] Int. Cl.[7] ..... B65H 5/00

[52] U.S. Cl. ..... 271/10.03; 271/10.05; 271/10.07; 271/35; 271/165

[58] Field of Search ..... 271/10.03, 10.05, 271/10.06, 10.07, 10.01, 35, 37, 38, 111, 16, 114, 116, 125, 166, 165, 167, 19

[56] References Cited

U.S. PATENT DOCUMENTS

| | | | |
|---|---|---|---|
| 3,908,983 | 9/1975 | Long | 271/35 |
| 3,949,981 | 4/1976 | McInerny | 271/178 |
| 4,651,983 | 3/1997 | Long | 271/35 |
| 4,715,593 | 12/1987 | Godlewski | 271/35 |
| 4,934,685 | 6/1990 | Shifley | 271/35 |
| 5,393,045 | 2/1995 | Fujimoto | 271/111 |
| 5,397,107 | 3/1995 | Wolog et al. | 271/116 |
| 5,443,359 | 8/1995 | Miller et al. | 271/111 |
| 5,772,199 | 6/1998 | Green | 271/10.06 |

FOREIGN PATENT DOCUMENTS

| | | | |
|---|---|---|---|
| 0194950 | 11/1984 | Japan | 271/165 |
| 2 033 348 | 5/1980 | United Kingdom . | |
| 2033348A | 5/1980 | United Kingdom | 271/35 |
| WO 92 12085 | 7/1992 | WIPO . | |

*Primary Examiner*—H. Grant Skaggs
*Attorney, Agent, or Firm*—Rader, Fishman & Grauer PLLC

[57] ABSTRACT

A sheet feeder has a pair of rearward feed belts declining in a downstream direction at a first angle for supporting a rear portion of a stack of sheets and a forward feed belt declining in a downstream direction at a lesser angle than the first angle positioned for supporting a front portion of the stack of sheets below the rear portion of the stack of sheets. With this arrangement, the weight of a stack of sheets on the feeder is shifted forwardly to assist in ensuring entraining frictional engagement of the bottom sheet with the forward feed belt. Optionally, a feed wheel overlies the downstream end of the forward feed belt and forms a nip therewith. Preferably the forward feed belt, the rearward feed belts, and the feed wheel are each separately driven with the rearward feed belts being driven through a one-way clutch permitting free movement of the rearward feed belts in the downstream direction. Photocells and a controller allow, on demand, a feeding cycle comprising activation of the forward feed belt followed by deactivation of the forward feed belt and pulsing of the feed wheel followed by pulsing of the rearward feed belts. This feeds a sheet from the bottom of the stack and prepares the next sheet for feeding by contouring the middle portion of this sheet so that it is separated from the stack.

10 Claims, 6 Drawing Sheets

STACKED SHEET FEEDER

BACKGROUND OF THE INVENTION

U.S. Pat. No. 4,651,983 issued Mar. 24, 1987 to Long describes a card feeder comprising a pulsed feed wheel which overlies and forms a nip with a feed belt. Cards are fed from the bottom of a card stack by the feed belt fanning the bottom cards forwardly and then pulsing the feed wheel to move the bottom card through the nip. While this arrangement works well, there is a limit to the size of the stack beyond which jams become frequent. In particular, with an overlarge stack, the bottom cards tend to move in blocks rather than fanning forwardly individually.

This invention seeks to overcome drawbacks of known stack feeders.

SUMMARY OF THE INVENTION

In accordance with the present invention, there is provided a sheet feeder comprising: a rearward feed belt declining in a downstream direction at a first angle from the horizontal for supporting a rear portion of a stack of sheets; a forward feed belt declining in a downstream direction at a lesser angle from the horizontal than said first angle positioned for supporting a front portion of said stack of sheets below said rear portion of said stack of sheets; and a drive connected through a one-way clutch to said rearward feed belt for driving said rearward feed belt in a downstream direction, said one-way clutch allowing said rearward feed belt to be moved in said downstream direction without drag from said rearward feed belt drive.

In accordance with another aspect of the present invention, there is provided a method of feeding sheets from the bottom of a stack comprising the steps of: (i) driving a forward feed belt which declines from the horizontal in a downstream direction and supports a front portion of a stack to feed a bottom sheet from said stack; and (ii) pulsing a pulse feed wheel which forms a nip with said forward feed belt in order to feed a next bottom sheet partially through said nip; and (iii) pulsing a rearward feed belt which declines in a downstream direction from the horizontal at a greater angle declination than said forward feed belt and which supports a rear portion of said stack above said front portion of said stack to partially buckle a next bottom sheet in said stack in order to partially separate said next bottom sheet from said stack.

BRIEF DESCRIPTION OF THE DRAWINGS

In the figures which illustrate example embodiments of the invention.

DETAILED DESCRIPTION OF THE PREFERRED EMBODIMENTS

Figure 1:
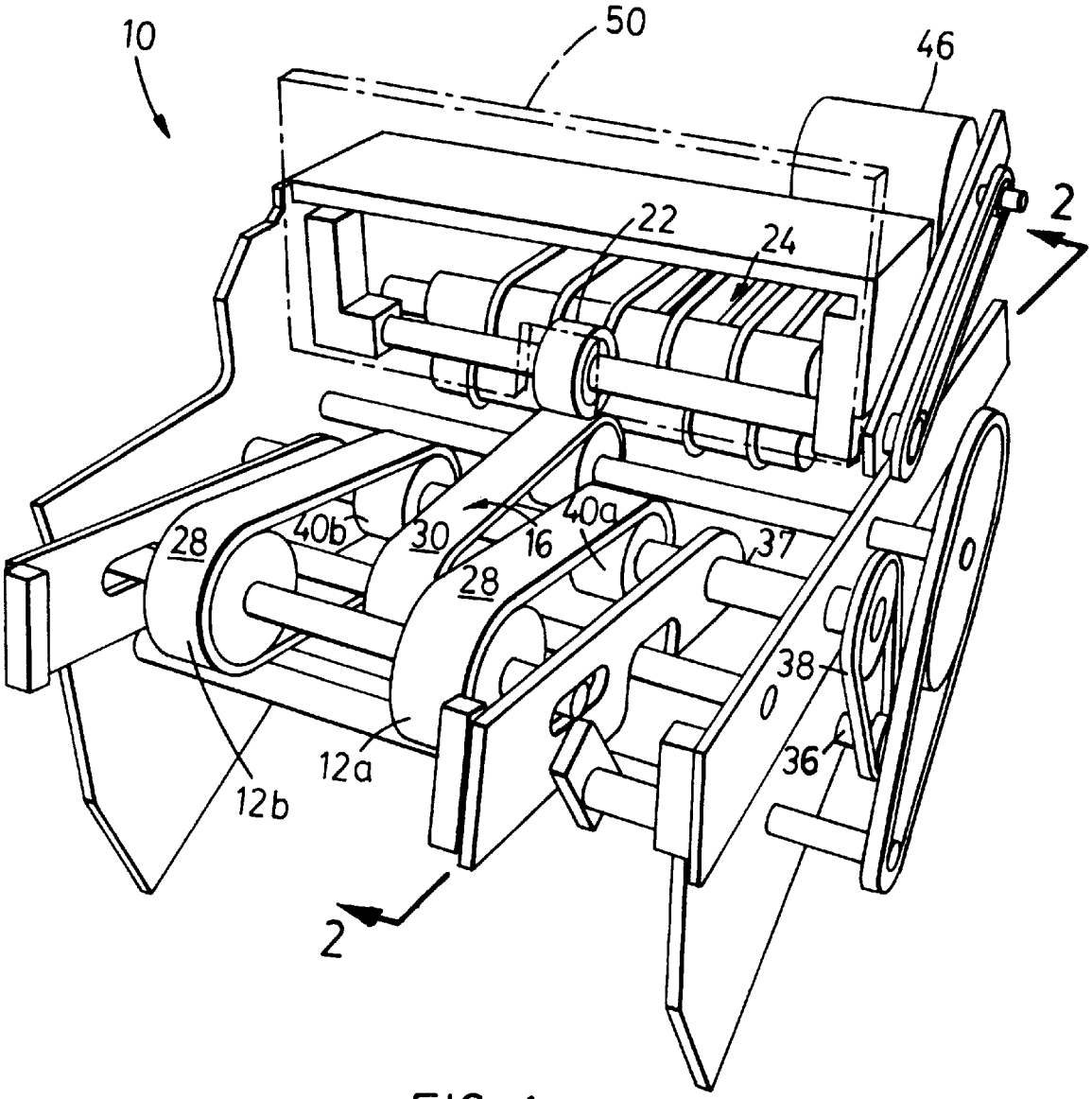
FIG. 1 is a perspective view of a feeder made in accordance with this invention.
Figure 2:
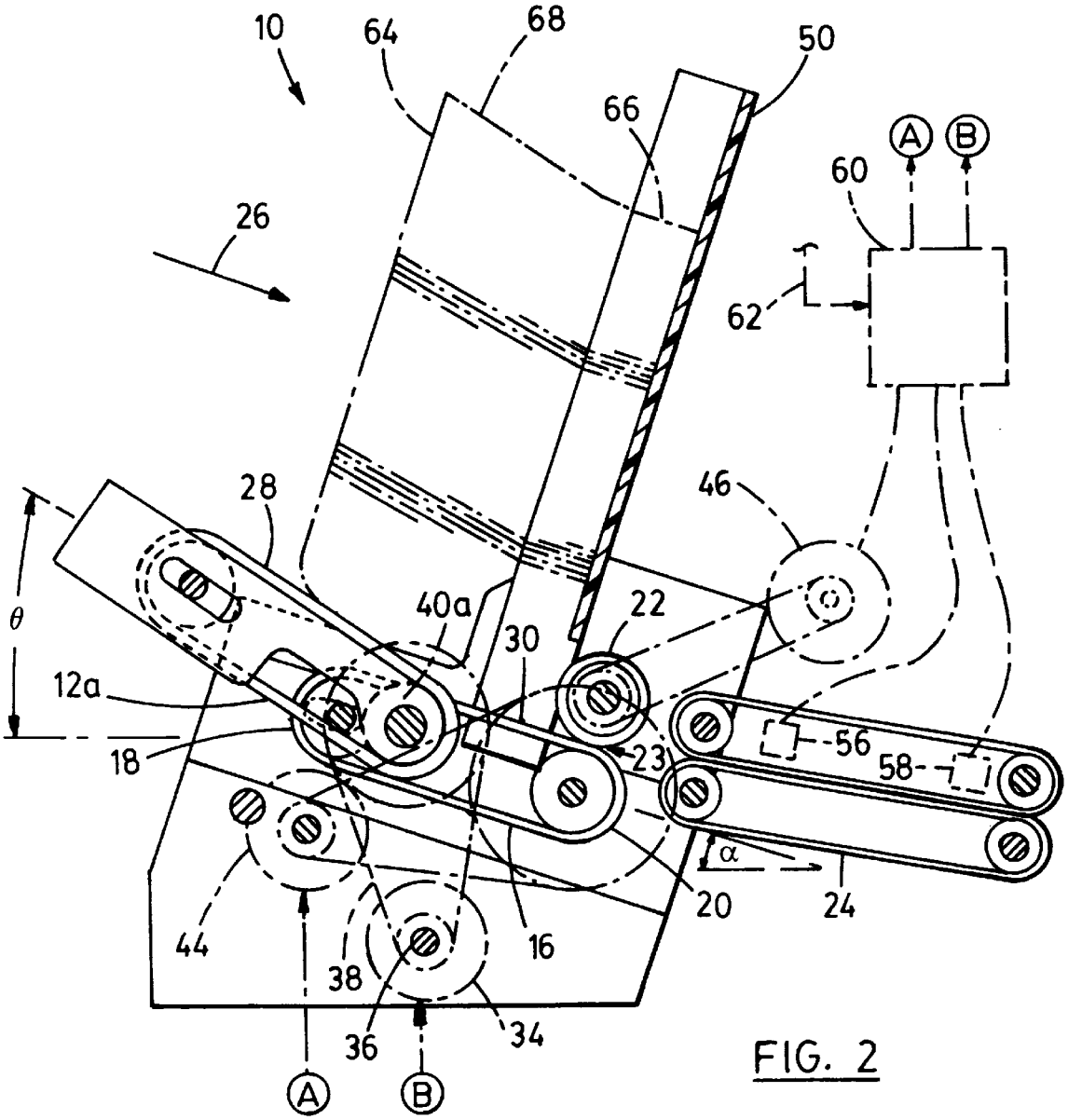
FIG. 2 is a cross-sectional view along the lines 2—2 of FIG. 1, FIGS. 3 through 5 are schematic views illustrating the operation of the feeder of FIGS. 1 and 2.

Turning to FIGS. 1 and 2, a stacked sheet feeder 10 comprises a pair of parallel rearward feed belts 12*a*, 12*b*, a forward conveyor in the nature of feed belt 16 with an upstream end 18 between the rearward feed belts and a downstream end 20 downstream of the rearward feed belts, and a feed wheel 22 which overlies the forward feed belt at its downstream end and forms a nip 23 therewith. A pinch feeding conveyor 24 extends downstream from the forward feed belt 16. As seen in FIG. 2, the rearward feed belts 12*a*, 12*b* decline in downstream direction 26 at an angle $\theta$ and forward feed belt 16 declines in downstream direction 26 at an angle, $\alpha$, which is less than angle $\theta$. Further, the stack supporting surface 28 of the rearward feed belts is above the stack supporting surface 30 of the forward feed belt.

Drive 34 (FIG. 2) drives the rearward feed belts through drive shafts 36, 37, pulley 38 and one-way clutches 40*a*, 40*b*. The one-way clutches free the stack supporting surface 28 of the rearward feed belts to be moved in a downstream direction when drive 34 is inactive. Drive 44 (FIG. 2) drives the forward feed belt 16 and drive 46 the feed wheel. The drive for the pinch feeding conveyor 24 is not shown.

A front stack support 50 extends over the feed wheel 22.

As seen in FIG. 2, an upstream and a downstream photocell 56, 58 are associated with the pinch feeding conveyor 24. A controller 60 receives an input from these photocells and outputs to drives 34, 44, and 46. The controller receives a demand input on line 62.

A stack 64 which rests on the feeder 10 has a front portion 66 supported on the lower stack supporting surface 30 of the forward feed belt and a rear portion 68 supported on the higher stack supporting surface 28 of the rearward feed belts. Because the rearward belts decline at a greater angle than the forward belt, this results in the lower portion of the stack bending to generally conform to the angled surfaces on which the stack rests. As further described hereinafter, that there is a gap between the middle portion of the bottom sheet of the stack and the forward feed belt 16.

Figure 3:
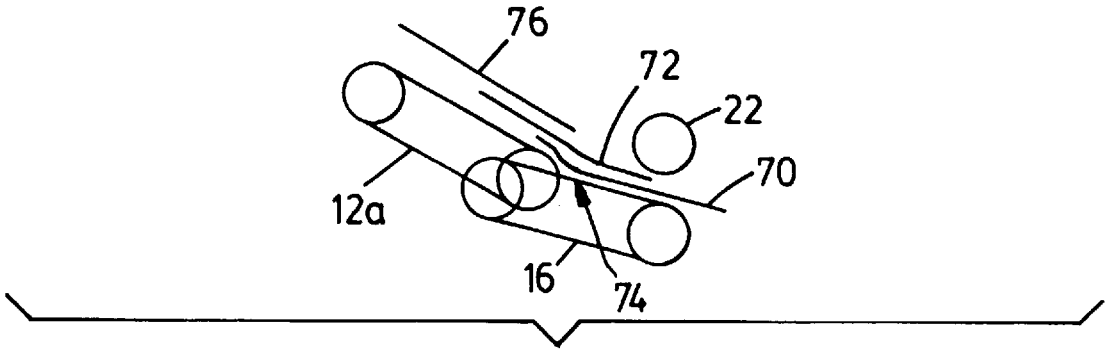
Figure 4:
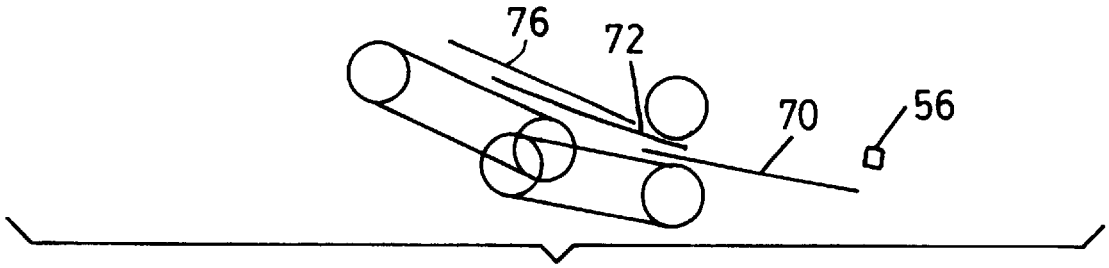
Figure 5:
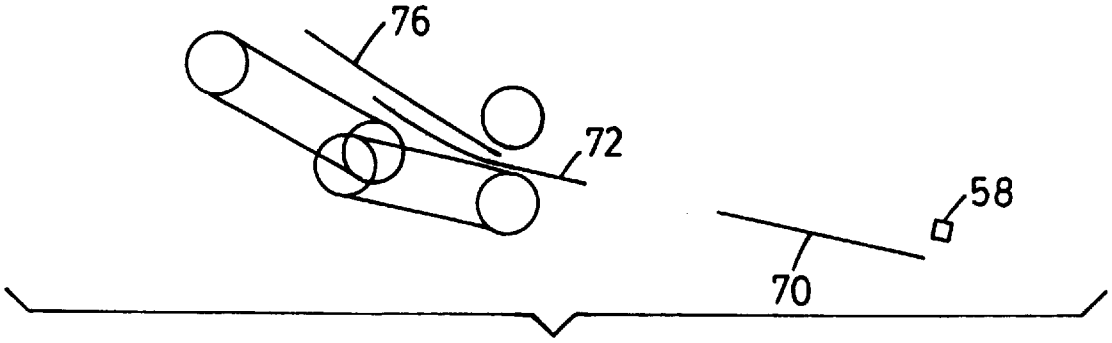

The operation of the feeder of FIGS. 1 and 2 is described in conjunction with FIGS. 3 through 5 along with FIGS. 1 and 2. It is assumed that the feeder 10 is initially in its quiescent state illustrated in FIG. 3 with all drives 34, 44, 46 stopped and the bottom two sheets 70 and 72 fanned forwardly of the remainder of the stack and both within nip 23 between forward feed belt 16 and feed wheel 22 with a contour (buckle) in the middle portion 74 of sheet 70. In this state, the controller 60 may receive a demand for a sheet on control line 62. When this occurs, the controller activates drive 44 for the forward feed belt 16. This feeds bottom sheet 70 from the stack to the continuously running pinch feeding conveyor 24 and also moves the next two sheets 72 and 76 forwardly, as illustrated in FIG. 4. In this connection, it is noted that the presence of sheet 72 in nip 23 above sheet 70 reduces the frictional drag on sheet 70 resulting from the fact that feed wheel 22 is stationary at this point in the operation of the feeder. Feeding of bottom sheet 70 is also facilitated by the contour in the middle portion 74 of the sheet which allows the forward feed belt 16 to "snap" feed sheet 70 when drive 44 is first activated in order to assist in overcoming the friction between bottom sheet 70 and the remainder of the sheet stack. It is also noted that as feed belt 16 begins to feed sheets 72 and 76, the one-way clutches 40*a*, 40*b* of rearward feed belts 12*a*, 12*b* allow these feed belts to follow the downstream feeding of sheets 72 and 76 so that these sheets need not overcome their static friction with these feed belts.

When sheet 70 trips the first photocell 56, the feed wheel 22 is pulsed by controller 60 to feed the next bottom sheet 72 further into the nip between forward feed belt 16 and feed wheel 22 and to feed the following sheet, sheet 76 into this nip, as illustrated in FIG. 5. When sheet 70 trips the second photocell 58, the rear feed belts 12*a*, 12*b* are pulsed to jog the rear portion of sheet 72 forwardly. This buckles the sheet 72 to cause a contour in the middle portion of sheet 72. Drive 44 is then stopped, returning the sheets in the feeder to the quiescent configuration illustrated in FIG. 3 but with sheet 72 being the bottom sheet and sheet 76 the next sheet from the bottom. The cycle may then repeat when a demand is received for the next sheet.

It will be noted that stack 64 on the feeder is tilted forwardly due to the angle of stack support 50 (which makes approximately a right angle with forward feed belt 16) as well as the angles θ and α of the feed belts 12*a*, 12*b* and 16, respectively. This shifts the weight of the stack forwardly so that, with reference to FIG. 3, a greater weight is focused on the rear of sheet 70 when in the position illustrated in FIG. 3 which increases the frictional engagement of sheet 70 with the forward feed belt 16. This, together with the contour in the middle portion 74 of sheet 70 which reduces the frictional engagement of sheet 70 with sheet 72 and the presence of sheet 72 in nip 23 which reduces frictional drag on sheet 70, assists in ensuring proper feeding. The forward shifted weight of the stack also enhances the frictional engagement of sheet 72 with the forward feed belt 16 once sheet 70 is fed downstream out from under sheet 72. Therefore, this forward shifting also facilitates feeding of sheet 72.

Contouring of the bottom sheet in the stack assists in avoiding the problem of "blocking" wherein several sheets from the stack improperly feed together.

Optionally, feeder 10 may be modified to operate with forward feed belt 16 and rearward feed belts 12*a*, 12*b* running from the same drive but with the forward feed belt geared to run at a higher speed. In such instance, only one photocell is provided so that, on demand, the common drive for feed belts 12*a*, 12*b* and 16 is activated with feed belts 12*a*, 12*b* being "overdriven" by the bottom sheet's entrainment by the faster forward feed belt and the operation of the one-way clutches 40, 42. When a sheet interrupts the photocell, the common drive stops and the feed wheel 22 is pulsed. Such an arrangement will not contour the bottom sheet at the end of a feeding cycle. However, the powered downstream movement of the rearward feed belts 12*a*, 12*b* assists in ensuring that the bottom sheet feeds even if not initially entrained by the forward feed belt 16.

In the described embodiments, it is preferred that the feed wheel 22 is pulsed in the downstream direction 26, however, the feed will assist in feeding a sheet through the nip between the feed wheel and forward feed belt 16 even when pulsed in an upstream direction.

In the described embodiments, pinch feed conveyor 24 runs at a speed about 50% greater than the speed of forward feed belt 16 so that once a sheet is entrained by the pinch feed conveyor it is quickly pulled out of the nip between the forward feed belt 16 and the feed wheel 22.

Figure 6:
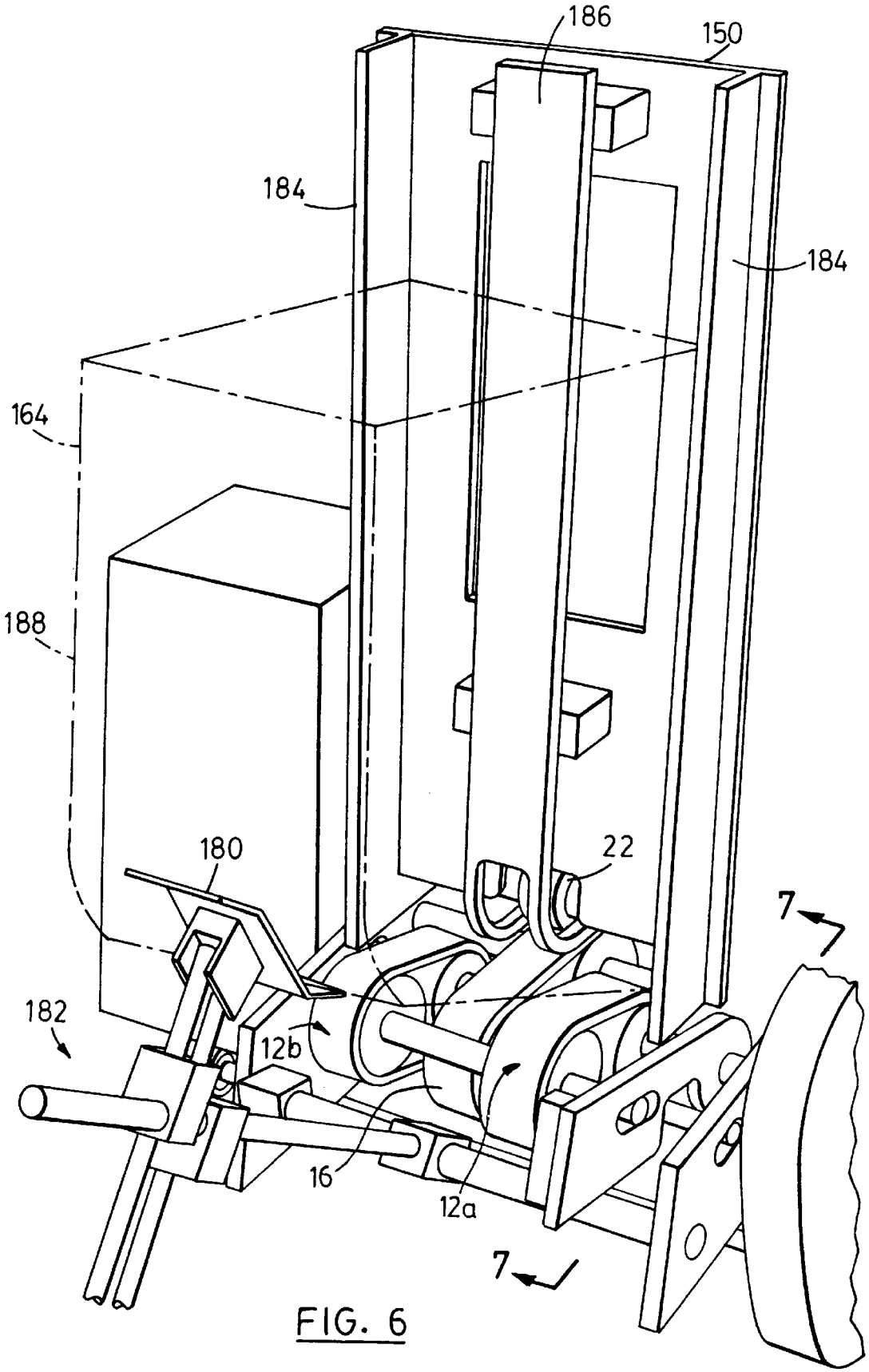
FIG. 6 is a perspective view of a feeder made in accordance with another embodiment of the invention.
Figure 7:
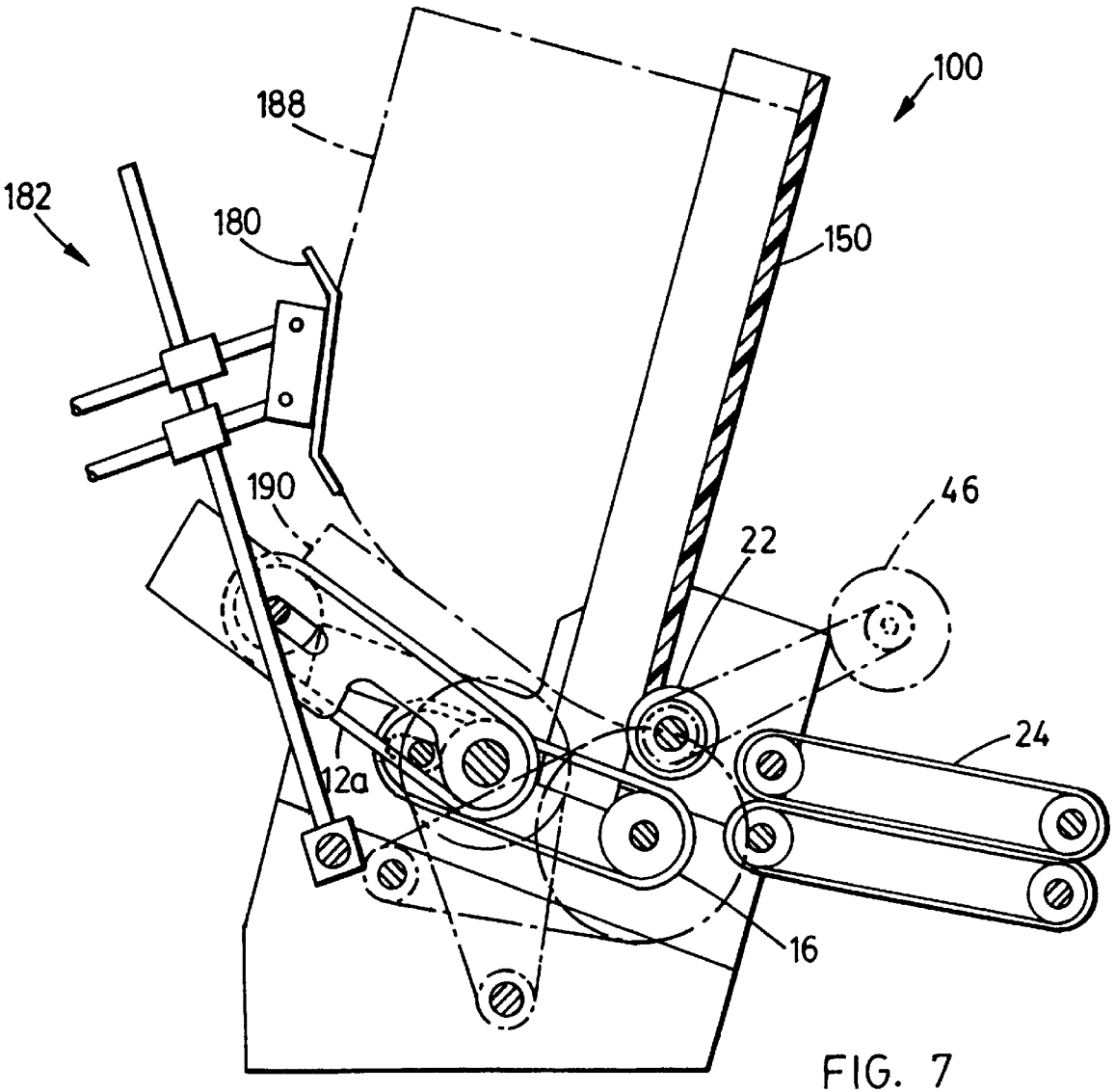
FIG. 7 is a cross-sectional view along the lines 7—7 of FIG. 6.

While the feeder 10 performs well even with sheet stacks of considerable height, with overly large stacks, the weight at the bottom of the stack becomes so great that blocking can occur. The modified feeder of FIGS. 6 and 7 avoids blocking even with very large stacks. Turning to FIGS. 6 and 7 wherein like parts have been given like reference numerals, feeder 100 has a shoe 180 supported by adjustable support 182 which permits the height and angle of the shoe to be selected as well as its distance from stack support 150. The stack support has peripheral sidewalls 184 and a medial guard 186 which surrounds the upstream side of feed wheel 22. The sidewalls may be adjustable to accommodate stacks of different width. Shoe 180 supports the rear of the upper portion 188 of stack 164 while a lower portion 190 (FIG. 7) of the rear of the stack falls below the shoe and rests on feed belts 12*a*, 12*b*. This arrangement reduces the weight of the stack on feed belts 12*a*, 12*b* which facilitates the disengagement of a bottom sheet from the stack from the remaining stack sheets. Therefore, this arrangements assists in ensuring single sheet feeding from the stack. The operation of feeder 100 is otherwise as described in conjunction with FIGS. 1 through 5 except that as sheets are fed from the bottom of the stack, the size of the lower portion 190 of the stack is reduced which lowers the front of the upper portion 188 of the stack thereby allowing additional sheets to fall to the lower stack portion.

Figure 8:
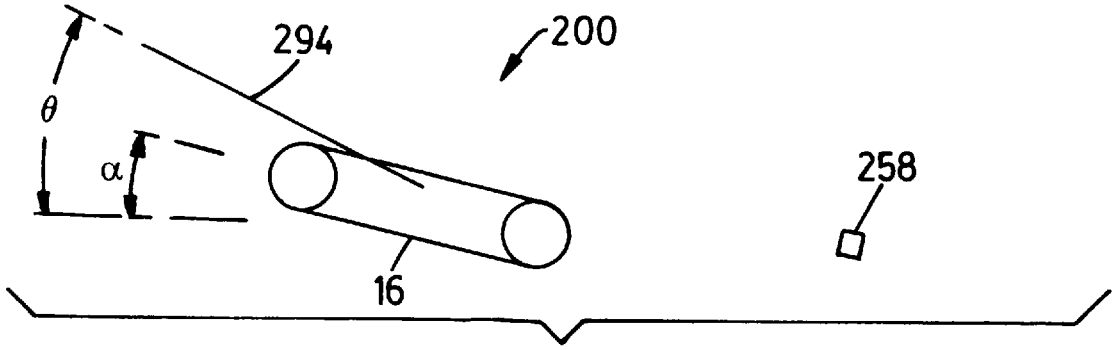
FIG. 8 is a schematic view of another embodiment of this invention.

FIG. 8 schematically illustrates a simplified feeder embodying concepts of this invention. Turning to FIG. 8, feeder 200 comprises a rearward low friction surface 294 making an angle θ with the horizontal and a forward feed belt 16 making an angle α with the horizontal. The angled surface and feed belt 16 shift the weight of a stack on feeder 200 forwardly. In operation, on demand, feeder 16 is driven which moves a sheet which had been partially fed from the bottom of a stack on the feeder downstream. The forward shifting of the weight of the stack assists in ensuring that the bottom sheet frictionally engages the forward feed belt and enhances the frictional engagement of the next sheet with the feed belt once the bottom sheet if fed out from under it in order that this next sheet may be partially fed to complete a feeding cycle when the initial sheet interrupts photocell 258.

Figure 9:
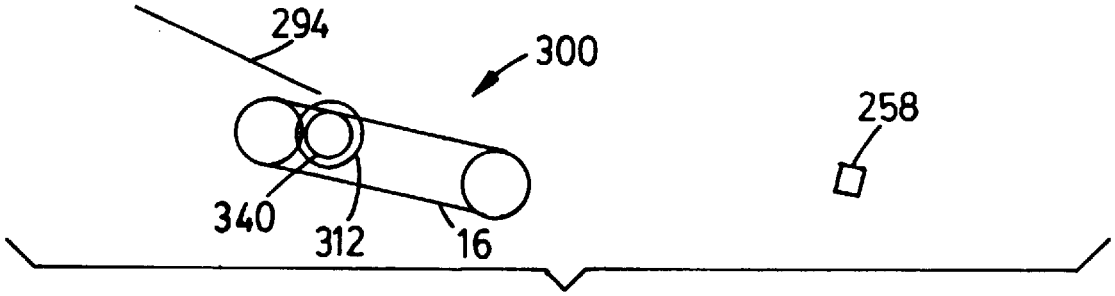
FIG. 9 is a schematic view of yet another embodiment of this invention.

FIG. 9 schematically illustrates a feeder 300 which is similar to FIG. 200 of FIG. 8 but includes a pulsed feed wheel 312 mounted on a one-way clutch 340. Feed wheel 312 is driven by its own drive. In operation, on demand, feeder 16 is driven which moves a sheet which had been partially fed from the bottom of a stack on the feeder downstream with feed wheel 312 freely rotating as the bottom sheet is fed due to one-way clutch 340. The forward shifting of the weight of the stack assists in ensuring that the bottom sheet frictionally engages the forward feed belt and enhances the frictional engagement of the next sheet with the feed belt once the bottom sheet if fed out from under it in order that this next sheet may be partially fed before feed belt 16 is stopped. After feed belt 16 is stopped (which occurs when photocell 258 is interrupted), feed wheel 312 is pulsed to contour the middle portion of the new bottom sheet thereby reducing its frictional engagement with the rest of the stack in preparation for feeding the new bottom sheet during the next feeding cycle.

Figure 10:
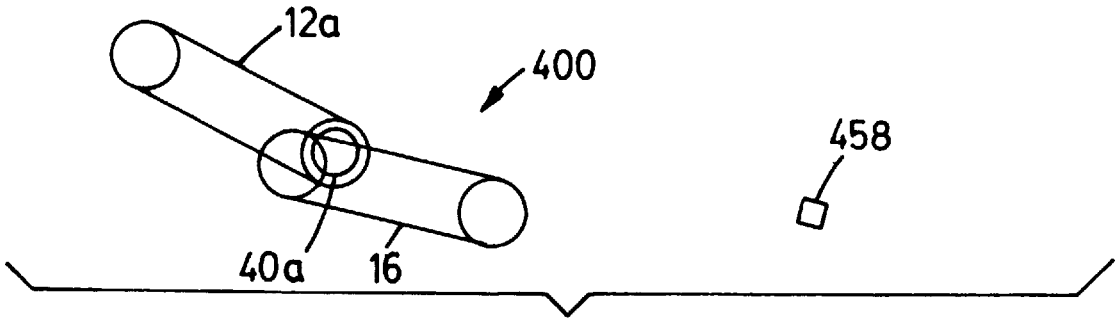
FIG. 10 is a schematic view of a further embodiment of this invention.

FIG. 10 schematically illustrates a feeder 400 which is similar to the feeder 10 of FIGS. 1 to 5 except that it omits pulsed feed wheel 22 (FIG. 1) and has only one photocell 458. In operation, on demand, feed belt 16 is driven which moves a sheet which had been partially fed from the bottom of a stack on the feeder downstream with the rearward feed belts (only 12*a* shown) freely rotating as the bottom sheet is fed due to the one-way clutches (only clutch 40*a* shown). The forward shifting of the weight of the stack assists in ensuring that the bottom sheet frictionally engages the forward feed belt and enhances the frictional engagement of the next sheet with the feed belt once the bottom sheet if fed out from under it in order that this next sheet may be partially fed before feed belt 16 is stopped. After feed belt 16 is stopped (which occurs when photocell 458 is interrupted), the rearward feed belts are pulsed to contour the middle portion of the new bottom sheet thereby reducing its frictional engagement with the rest of the stack in preparation for feeding the new bottom sheet during the next feeding cycle.

The sheets fed by the feeders of this invention may be in the nature of cards, letter sheets or other paper stock. The photocells may be replaced with any other type of sheet detector such as a camera. Further, the sheet detectors could be replaced with rotary encoders which signal the controller when a sheet is expected to have advanced to the appropriate point.

Other modifications will be apparent to those skilled in the art and, therefore, the invention is defined in the claims.

What is claimed is:

1. A sheet feeder comprising:

a rearward feed belt declining in a downstream direction at a first angle from the horizontal for supporting a rear portion of a stack of sheets;

a forward feed belt declining in a downstream direction at a lesser angle from the horizontal than said first angle positioned for supporting a front portion of said stack of sheets below said rear portion of said stack of sheets; and a drive connected through a one-way clutch to said rearward feed belt for driving said rearward feed belt in a downstream direction, said one-way clutch allowing said rearward feed belt to be moved in said downstream direction without drag from said rearward feed belt drive.

2. The feeder of claim 1 including a drive for said forward feed belt.

3. The feeder of claim 1 including a pulsed feed wheel forming a nip with said forward feed belt.

4. The feeder of claim 3 including a controller for cyclically (i) driving said forward feed belt to feed a bottom sheet from said stack and (ii) subsequently stopping said forward feed belt and pulsing said rearward feed belt to partially buckle a next bottom sheet in said stack in order to partially separate said next bottom sheet from said stack.

5. The feeder of claim 3 including a downstream conveyor for conveying a sheet downstream of said nip.

6. The feeder of claim 5 including a first sheet detector associated with said downstream conveyor and a second sheet detector associated with said downstream conveyor downstream of said first sheet detector.

7. The feeder of claim 6 including a controller for, responsive to said first sheet detector and said second sheet detector, cyclically (i) driving said forward feed belt to feed a bottom sheet from said stack, (ii) after said sheet has passed through said nip, pulsing said pulsed feed wheel to feed a next bottom sheet from said stack partially through said nip, and (iii) subsequently stopping said forward feed belt and pulsing said rearward feed belt to partially buckle said next bottom sheet in said stack in order to partially separate said next bottom sheet from said stack.

8. The feeder of claim 6 including a forward stack support making substantially a right angle with said forward feed belt.

9. The feeder of claim 5 including a shoe for supporting an upper rear portion of said stack above said rearward feed belt.

10. A method of feeding sheets from the bottom of a stack comprising:

(i) driving a forward feed belt which declines from the horizontal in a downstream direction and supports a front portion of a stack to feed a bottom sheet from said stack;

(ii) pulsing a pulse feed wheel which forms a nip with said forward feed belt in order to feed a next bottom sheet partially through said nip; and (iii) pulsing a rearward feed belt which declines in a downstream direction from the horizontal at a greater angle than an angle of declination of said forward feed belt and which supports a rear portion of said stack above said front portion of said stack to partially buckle said next bottom sheet in said stack in order to partially separate said next bottom sheet from said stack.

* * * * *